US010279467B2

(12) United States Patent
Ou

(10) Patent No.: US 10,279,467 B2
(45) Date of Patent: May 7, 2019

(54) TOOL SUSPENSION DEVICE

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 446 days.

(21) Appl. No.: 15/088,643

(22) Filed: Apr. 1, 2016

(65) Prior Publication Data

US 2016/0214254 A1 Jul. 28, 2016

Related U.S. Application Data

(63) Continuation-in-part of application No. 14/196,233, filed on Mar. 4, 2014, now abandoned.

(51) Int. Cl.
*B25H 3/04* (2006.01)

(52) U.S. Cl.
CPC ..... *B25H 3/04* (2013.01)

(58) Field of Classification Search
CPC ..... B25H 3/04; A47F 5/0006; A47B 81/00
See application file for complete search history.

(56) References Cited

U.S. PATENT DOCUMENTS 5,368,164 A * 11/1994 Bennett ..... B25H 3/003 206/373
5,535,882 A * 7/1996 Liu ..... B25H 3/003 206/376
6,431,373 B1 * 8/2002 Blick ..... B25H 3/003 206/378
8,307,980 B1 * 11/2012 Kao ..... B25H 3/04 206/372
8,403,155 B1 * 3/2013 Kao ..... B25H 3/04 206/376
8,550,244 B1 * 10/2013 Ou ..... B65D 71/50 206/378
9,205,553 B2 * 12/2015 Ou ..... B25H 3/04
9,452,524 B1 * 9/2016 Kao ..... B25H 3/04
2010/0320162 A1 12/2010 Kao
2013/0153521 A1 6/2013 Kao
2013/0240394 A1 * 9/2013 Wang ..... B25H 3/00 206/372

FOREIGN PATENT DOCUMENTS

TW M435978 8/2012

* cited by examiner

*Primary Examiner* — Anthony D Stashick
*Assistant Examiner* — James R Way
(74) *Attorney, Agent, or Firm* — Muncy, Geissler, Olds & Lowe, P.C.

(57) ABSTRACT

A tool suspension device includes a seat, a receiving element, and a fixing element. The seat has a suspension portion. The seat has a first positioning portion on a front face thereof. The receiving element has at least one tool receiving portion and a second positioning portion. The second positioning portion is detachably positioned to the first positioning portion so that the receiving element is detachably disposed on the seat. The tool receiving portion is located at a face of the receiving element opposite to the seat. The fixing element is disposed on the seat and the receiving element to fix the seat and the receiving element together. Thus, the seat can be applicable for receiving elements designed for various kinds of tool.

4 Claims, 4 Drawing Sheets

TOOL SUSPENSION DEVICE

FIELD OF THE INVENTION

The present invention is a CIP of application Ser. No. 14/196,233, filed Mar. 4, 2014, the entire contents of which are hereby incorporated by reference.

BACKGROUND OF THE INVENTION

Description of the Prior Art

A conventional tool suspension device, as disclosed in patent TW M435978, has a suspension hole or other suspension means on the top thereof and a tool receiving portion, such as protrusion for sockets to sleeve onto. Thereby, tools such as sockets can be displayed and hung.

However, the tool receiving portion and the suspension portion are formed on a single piece. Thus, to receive tools in a variety of sizes and specification, molds in various sizes are necessary so that the cost of preparing molds is quite high. Also, tool suspension devices in various sizes result inventory pressure.

Besides, the publication U.S. 2013/0153521 also disclosed a tool suspension assembly having track grooves and connecting devices slidably received therein. That is, the track groove has two lateral openings at the top and the bottom, and the connecting device can enter the track groove only via the lateral openings. In addition, the connecting device may fall down via the lateral opening if the connecting device is not positioned with the button.

SUMMARY OF THE INVENTION

The main object of the present invention is to provide a tool suspension device having a suspension portion and a receiving portion independent from each other.

To achieve the above and other objects, the tool suspension device of the present invention includes a seat, a receiving element, and a fixing element.

The seat has a suspension portion. The seat has a first positioning portion on a front face thereof. The receiving element has at least one tool receiving portion and a second positioning portion. The second positioning portion is detachably positioned to the first positioning portion so that the receiving element is detachably disposed on the seat. The tool receiving portion is located at a face of the receiving element opposite to the seat. The fixing element is disposed on the seat and the receiving element to fix the seat and the receiving element together.

Because the seat and the receiving element are independent from each other to be single pieces respectively, the seat can be applicable for kinds of receiving elements. Thus, only the receiving element has to be manufactured according to tools to be received. Cost of molding is reduced, and inventory pressure is also prevented. In addition, due to the positioning mechanism and the fixing mechanism between the seat and the receiving element, structure strength and performance of anti-theft can be ensured.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
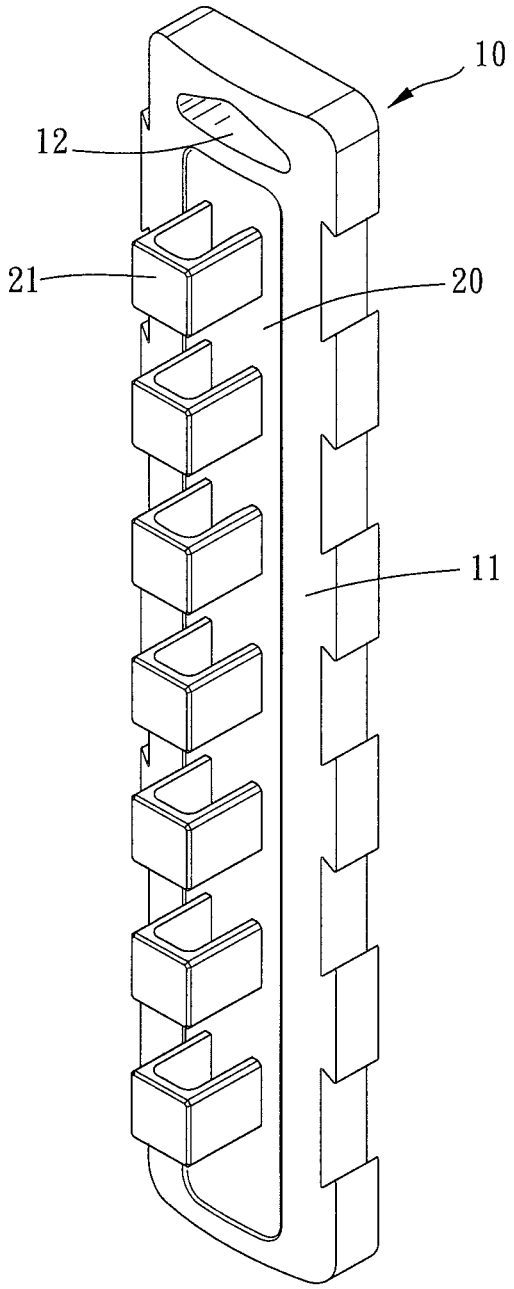
FIG. 1 is a stereogram of the present invention.
Figure 2:
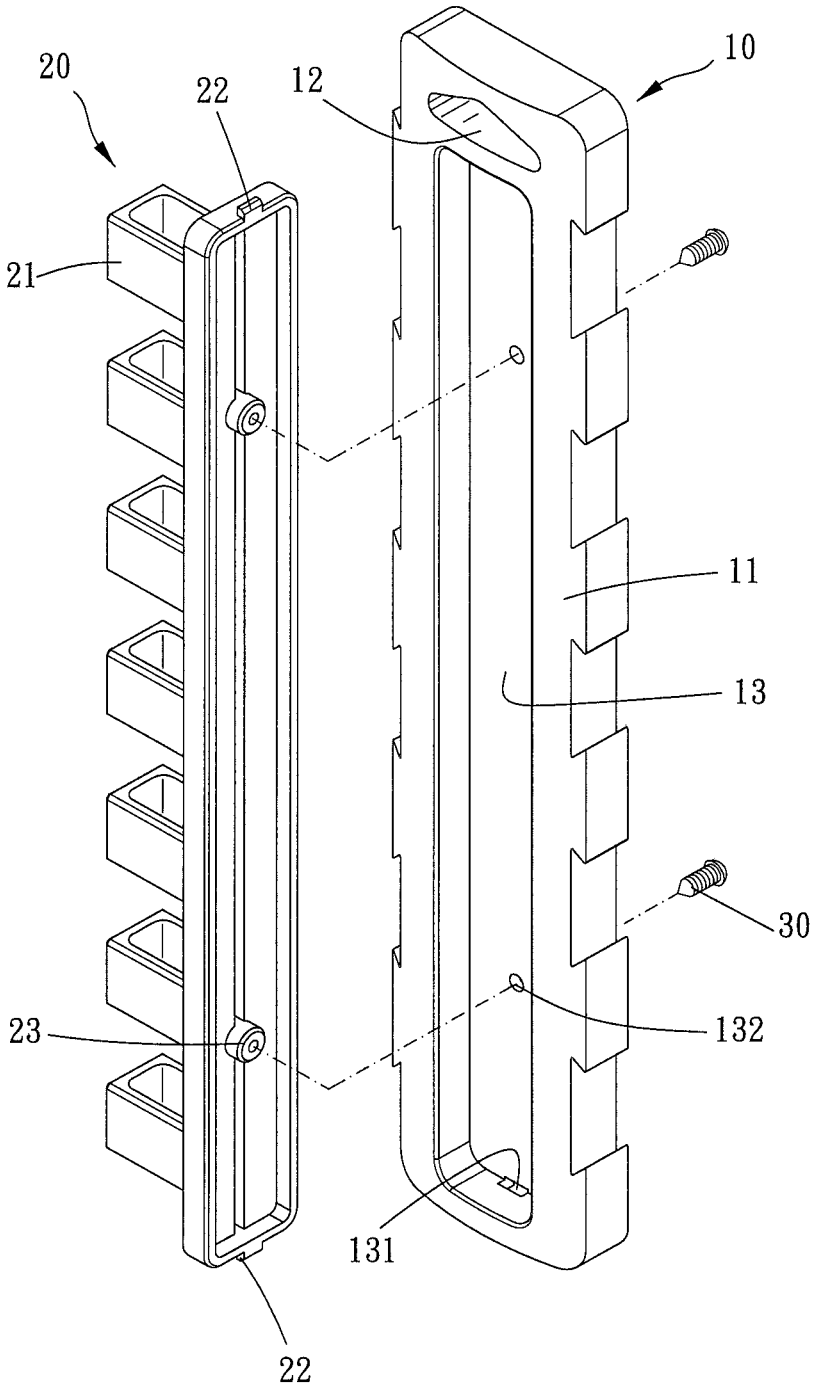
FIG. 2 is a breakdown drawing of the present invention.
Figure 3:
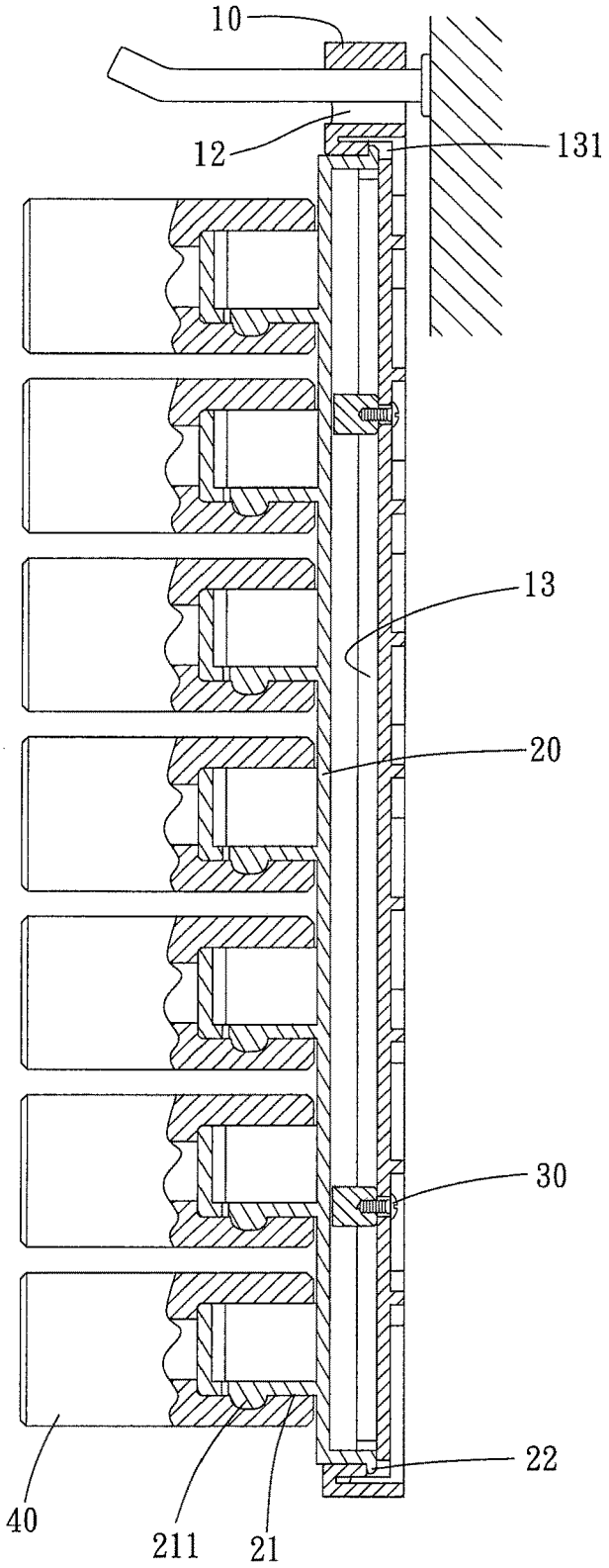
FIG. 3 is a profile of the present invention.
Figure 4:
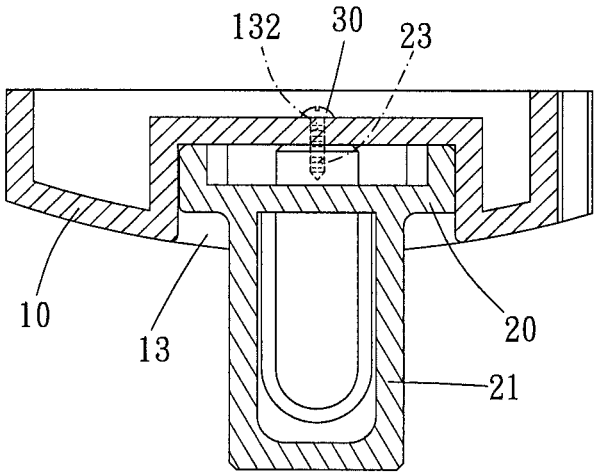
FIG. 4 is a profile at another angle of the present invention.

Please refer to FIG. 1 to FIG. 4, the tool suspension device of the present invention includes a seat 10, a receiving element 20, and a fixing element 30.

The seat 10 has a suspension portion 12. The seat 10 has a first positioning portion on a front face 11 thereof, and the receiving element 20 has at least one tool receiving portion 21 and a second positioning portion. The second positioning portion is detachably positioned to the first positioning portion to position the receiving element 20 onto the seat 10. The tool receiving portion 21 is located at a face of the receiving portion 20 opposite to the seat 10. The fixing element 30 is disposed on the seat 10 and the receiving element 20 to fix the seat 10 and the receiving element 20 together.

More specifically, each of the seat 10 and the receiving element 20 is substantially rectangle board-shaped. The suspension portion 12 is a suspension hole. However, the suspension portion can be other suspension means in other possible embodiments, such as a hook. In the present embodiment, the tool receiving portion 21 is a polygonal protrusion for a socket to sleeve onto, and the polygonal protrusion has a bump 211 to be received in a restriction recess on an inner wall of the socket 40. However, the tool receiving portion can be other structure such as rings in other possible embodiments.

The seat 10 is formed with a receiving groove 13 whose shape corresponds to a contour of the receiving element 20. That is, the receiving groove 13 is substantially rectangle. More specifically, the receiving groove 13 has a side wall, a bottom, and a top opening opposite to the bottom. Side walls of the receiving element 20 are completely surrounded by the side wall of the receiving groove 13 when the receiving element 20 is received in the receiving groove 13 so that the receiving element 20 is able to leave the receiving groove 13 only via the top opening. The first positioning portion includes at least one notch 131 formed on a side wall of the receiving groove 13. The second positioning portion includes at least one protrusion 22 formed on one of the side walls of the receiving element 20 wherein the protrusion 22 has a shape corresponding to the notch 131. When the receiving element 20 is received in the receiving groove 13, the receiving element 20 is positioned by the engagement of the protrusion 22 and the notch 131. Preferably, the protrusion 22 has a chamfer on a face thereof facing the seat 10 so as to facilitate the protrusion 22 enter the notch 131. In the present embodiment, two notches 131 are formed on two opposite side walls of the receiving groove 13 respectively, and each notch 131 connects to the bottom of the receiving groove 13. The receiving element 20 is formed with two protrusions 22 on two opposite side walls thereof. The protrusion 22 is preferably slightly resilient for entering the notch 131. Thereby, when the two protrusions 22 are received in the two notches 131 respectively, the receiving element 20 is positioned well in the receiving groove 13 and is prevented from separating from the seat 10. In the present embodiment, the fixing element 30 is a bolt. The seat 10 is formed with a through hole 132, and the receiving element 20 is formed with a threaded hole on a face facing the seat 10. The bolt is inserted through the through hole 132 and then threaded to the threaded hole 23 to fix the receiving element 20 onto the seat 10. Thereby, the receiving element 20 is unable to be separated from the seat 10. In addition, the fixing element 30 helps improve structure strength.

Besides, in the present embodiment, the face of the receiving element 20 opposite to the seat 10 is not protruded above the front face 11 of the seat 10. In other words, the receiving element 20 is not higher than the front face 11 of the seat 10. Thus, the receiving element 20 and the seat 10 look like a single piece.

In the present embodiment, the seat is engaged with only one receiving element. However, in other possible embodiments, the seat may be engaged with plural receiving elements. For example, two receiving elements are received in the receiving groove of the seat at the same time. Thereby, plural receiving elements can be positioned on a single seat for suspension and displaying.

About manufacturing, only the receiving element has to be shaped and molded according to the specification and size of tool. The seat can be molded in a constant size and are applicable for all the receiving elements. Thus, cost of molds and inventory pressure are reduced.

Besides, the present invention can be sold as a tool package including a few of seats and plural receiving elements. Thus, users can assemble the seat with the desired receiving element for suspension, and the receiving element can be replaced with other ones easily.

What is claimed is:

1. A tool suspension device, including:

a seat, having a suspension portion, the seat having a first positioning portion on a front face thereof;

a receiving element, having at least one tool receiving portion and a second positioning portion, the second positioning portion being detachably positioned to the first positioning portion so that the receiving element is detachably disposed on the seat, the tool receiving portion being located at a face of the receiving element opposite to the seat;

a fixing element, disposed on the seat and the receiving element to fix the seat and the receiving element together;

wherein the seat is formed with a receiving groove whose shape corresponds to a contour of the receiving element, the receiving groove has a side wall, a bottom, and a top opening opposite to the bottom, side walls of the receiving element are completely surrounded by the side wall of the receiving groove when the receiving element is received in the receiving groove so that the receiving element is able to leave the receiving groove only via the top opening, the first positioning portion includes at least one notch formed on the side wall of the receiving groove, the second positioning portion includes at least one protrusion formed on one of the side walls of the receiving element wherein the protrusion has a shape corresponding to a shape of the notch, the receiving element is positioned in the receiving groove when the protrusion is received in the notch, the top opening of the receiving groove has a shape corresponding to the shape of the receiving element so that the receiving element is able to be placed into the receiving groove via the opening directly;

wherein the protrusion has a chamfer on a face thereof facing the seat;

wherein the seat is formed with a through hole, the receiving element is formed with a threaded hole on a face facing the seat, the fixing element is a bolt, the bolt is inserted through the through hole and is threaded to the threaded hole to position the receiving element on the seat.

2. The tool suspension device of claim 1, wherein the face of the receiving element opposite to the seat is not protruded above the front face of the seat.

3. The tool suspension device of claim 1, wherein the suspension portion is a suspension hole.

4. The tool suspension device of claim 1, wherein the tool receiving portion is a polygonal protrusion.

* * * * *